US006116465A

United States Patent [19]

Bouzaglo

[11] Patent Number: 6,116,465

[45] Date of Patent: Sep. 12, 2000

[54] CONTAINER STOPPER WITH SHUT-OFF VALVE

[76] Inventor: Gabriel Bouzaglo, 39 Rue Rene Nicod, 01100 Oyonnax, France

[21] Appl. No.: 09/202,736

[22] PCT Filed: Jun. 11, 1997

[86] PCT No.: PCT/FR97/01036

§ 371 Date: Dec. 14, 1998

§ 102(e) Date: Dec. 14, 1998

[87] PCT Pub. No.: WO97/47531

PCT Pub. Date: Dec. 18, 1997

[30] Foreign Application Priority Data

Jun. 13, 1996 [FR] France ..... 96 07340

[51] Int. Cl.[7] ..... B65D 35/00

[52] U.S. Cl. ..... 222/92; 222/486; 222/494; 222/517; 222/556

[58] Field of Search ..... 222/92, 212, 402.16, 222/486, 491, 494, 517, 556, 563

[56] References Cited

U.S. PATENT DOCUMENTS

| | | | |
|---|---|---|---|
| 1,954,717 | 4/1934 | Strang | 222/60 |
| 2,330,939 | 10/1943 | Wilson | 221/62 |
| 3,104,039 | 9/1963 | Dike | 222/536 |
| 4,230,240 | 10/1980 | Laauwe | 222/494 |
| 4,773,571 | 9/1988 | Hagan et al. | 222/494 |
| 4,846,810 | 7/1989 | Gerber | 604/247 |
| 5,080,139 | 1/1992 | Haviv | 137/800 |
| 5,092,855 | 3/1992 | Pardes | 604/247 |
| 5,305,786 | 4/1994 | Debush | 137/512.3 |
| 5,553,745 | 9/1996 | McMillian | 222/92 |
| 5,836,484 | 11/1998 | Gerber | 222/494 |

FOREIGN PATENT DOCUMENTS

| | | | |
|---|---|---|---|
| 0172711 | 2/1986 | European Pat. Off. | 222/494 |
| 291962 | 7/1953 | Switzerland . | |
| 757034 | 7/1956 | United Kingdom . | |

*Primary Examiner*—Joseph A. Kaufman
*Attorney, Agent, or Firm*—Lackenbach Siegel Marzullo Aronson & Greenspan

[57] ABSTRACT

The container stopper comprises a cylindrical part to be engaged in the neck of a container and has a groove which extends peripherally on at least one part of the cylindrical part circumference. Two channels separated from each other, extend in the cylindrical part of the stopper and open into the groove through orifices respectively spaced from each other in the groove peripheral direction. A diaphragm of elastomeric material closely matches the shape of the cylindrical part and the groove surface covering the orifices of the two channels. The diaphragm forms a shut-off valve that by its elastic deformation, allows a fluid substance contained in the container to flow from inside the container outwards, as well as from outside into the said container.

17 Claims, 5 Drawing Sheets

CONTAINER STOPPER WITH SHUT-OFF VALVE

BACKGROUND OF THE INVENTION

1. Field of the Invention

The present invention relates to a stopper for a container with a neck, of the kind comprising a body which may be fixed and sealed to the container's neck and wherein at least a duct is formed for emptying the container and a shutoff valve for closing up said duct. The present invention also relates to a container provided with such a stopper.

2. Description of the Prior Art

Such stoppers of the aforementioned kind are already known. Such a stopper is for example described in French Patent FR-2 687 130. This known stopper comprises at least four separate parts, i.e. a body, a cage, a ball and a spiral spring, which have to be assembled together to form the stopper. As a result, manufacturing of the stopper is relatively complicated.

French Patent FR-2 616 756 further describes a stopping device for a flask, which only comprises two parts, both formed as a cap. One of these two parts or internal cap, in use, just caps the flask's neck and is sealed thereto, whereas the other unit or external cap caps the internal cap and may rotate relatively to the latter around an axis coinciding with the axis of the flask's neck. A chamber is provided between the upper walls of both caps. The upper wall of the external cap is formed as a thin wall so as to form an elastic diaphragm, and it bulges towards the upper wall of the internal cap. At its center, the elastic diaphragm includes an orifice which engages with a boss formed at the center of the upper side of the internal cap, such as to seal the central orifice of the elastic diaphragm. On another side, the upper wall of the internal cap includes two eccentric orifices, which are formed on both sides of the central boss and which engage with two bosses formed at a matching location on the lower side of the elastic diaphragm, so as to seal these two orifices. By rotating the external cap relatively to the internal cap, a slight elastic distortion of the diaphragm occurs and both bosses thereof clear both orifices of the upper wall of the internal cap, thereby the inside of the flask communicates with the chamber formed between the upper walls of both caps. Now, if the pressure inside the flask is increased, for example by manually applying pressure on the distortable walls thereof, distortion of the elastic diaphragm is increased and the central orifice of the diaphragm moves away from the central boss of the internal cap, thereby the aforementioned chamber communicates with the outside of the flask, so that the fluid substance contained therein can flow towards the outside of the flask. Although the stopping device of French Patent FR-2 616 756 includes a smaller number of parts and that as a result, its manufacturing is simpler than that of the stopper of French Patent FR-2 687 130, it has nevertheless certain drawbacks. Especially, when first using the flask, the elastic diaphragm distorts under the effect of an increase in pressure inside the flask and the substance which penetrates into the chamber between the upper walls of both caps may flow not only towards the outside through the central orifice of the elastic diaphragm, but also into the ring-shaped space between the cylindrical skirts of both caps. It is very difficult to extract any substance therefrom which has penetrated into this ring-shaped space, particularly when it is a sticky or thick substance. As a result, this substance will stagnate between the skirts of both caps throughout the period of use of the flask. Not only is this not hygienic, notably for food substances, but also the substance included between the skirts of both caps may cause both caps to stick to one another, thus making a subsequent opening of the stopper device very difficult, if not impossible.

Furthermore, it may happen that under the action of strong pressure inside the flask, the elastic diaphragm distorts to the point that its curvature is reversed, i.e. from concave to convex, and that it remains in the convex state when pressure is released, so that the stopping device stays open. As a result, air can penetrate into the inside the flask. This can impair good preservation or sterility of the substance contained in the flask.

In the case considered above, the stopping device must then be sealed once more by applying pressure on the elastic diaphragm so as to bring it back to its concave state. If this operation is carried out with a finger, this is bad for hygiene or this may be harmful if the flask contains a substance, for example a toxic or corrosive substance, which must not be touched with fingers. Finally, with the stopping device of French Patent FR-2 616 756, as with the stopper of French Patent FR-2 687 130, it is impossible to fill the flask without having removed beforehand the stopper or stopping device. Indeed, the shutoff valve included in the stopper of French Patent FR-2 687 130, like the elastic diaphragm of the stopping device of French Patent FR-2 616 756 only allows flow from the inside to the outside of the flask. Accordingly, if particular precautions or restricting steps are not adopted upon filling the flask, the filling substance is in contact with air from the environment during the whole filling period and until the stopper or stopping device is put back into place in the flask's neck.

SUMMARY OF THE INVENTION

Therefore, the object of the present invention is to overcome the aforementioned drawbacks of the known stoppers or stopping devices described above.

For this purpose, the stopper according to the invention is characterized in that the stopper's body includes a cylindrical part for engaging into the neck of the container, which has on its cylindrical surface a groove which extends as a circumference on at least one part of the periphery of said cylindrical part, in that the duct comprises first and second channels which are separated from each other, extend into the cylindrical part of the body and emerge, at one of the ends, in said groove through the first and second orifices spaced from one another in the circumferential direction of the groove respectively, the first channel emerging, at its other end, through a third orifice located in a first end surface of the body which, in use, is located inside the container, the second channel emerging, at its other end, through a fourth orifice located in a second end surface of the body which, in use, is located outside the container, and in that the shutoff valve is formed by a diaphragm in elastomeric material which tightly encircles the body's cylindrical part and the groove surface covering the first and second orifices of both channels on which, through its elastic distortion, allows a fluid substance contained in the container to flow both from the inside to the outside of the container, and from the outside to the inside of said container.

The stopper according to the invention may be advantageously made as an integral part by a known technique of bi-injection molding. Plastic material for forming the body of the stopper and elastomeric material for forming the diaphragm may be injected sequentially or simultaneously into the mold according to whether either one of the known techniques for bi-injection moulding is used.

Although this is not absolutely necessary, a cap may be added to the stopper according to the invention. Preferably, the cap includes a nozzle and is rotatively mounted on the body of the stopper in such a way that, in a first position of the cap's rotation, the internal channel of the nozzle coincides with the second channel of the stopper's body and that, in a second position of the cap's rotation, the internal channel of the nozzle does not coincide with the second channel of the body, so that this second channel is sealed by the cap. Such a cap may not be needed when there is no pressure inside the container while it is not in use. Whereas, the aforementioned cap will be preferably added to the stopper when there is permanently some pressure inside the container, for example, when the latter contains a fizzy drink or a fluid substance and a gas propellant.

The stopper according to the invention, optionally provided with its cap, may be used with containers having most varied structures and forms and containing most varied fluid substances, with the provision that the containers are provided with a neck. For example, with the stopper according to the invention, a metal, glass or stiff or half-stiff plastic bottle or flask, a bag or bladder in a flexible material, etc., may be used as a container. In an advantageous application of present invention, the stopper and its cap may however be mounted on a container, the internal volume of which may vary from a value corresponding to the nominal capacity of the container to an almost zero value. For instance, such a variable capacity container may consist of a bag or bladder in a flexible plastic material or in a bottle, the body of which is formed like compressible bellows extendable in the longitudinal direction of the bottle, for example, like the bottle described in the French Patent Application filed on the same day as the present patent application, on behalf of the same applicant, and entitled: "Variable Capacity Plastic Bottle". When the stopper according to the invention is mounted on such a variable capacity container, put beforehand in a condition where its internal capacity is zero, the container may then be filled through the stopper's channels without having the substance introduced into the container come into contact with air from the environment, and the container may then be emptied without having air penetrate into the container. This is particularly advantageous for good preservation of the substance contained in the container and/or when a high degree of sterilisation must be maintained.

Others characteristics and advantages of the present invention will become more apparent from the following description of two exemplary embodiments of the invention in reference to the appended drawings wherein:

DETAILED DESCRIPTION OF THE INVENTION

Figure 1:
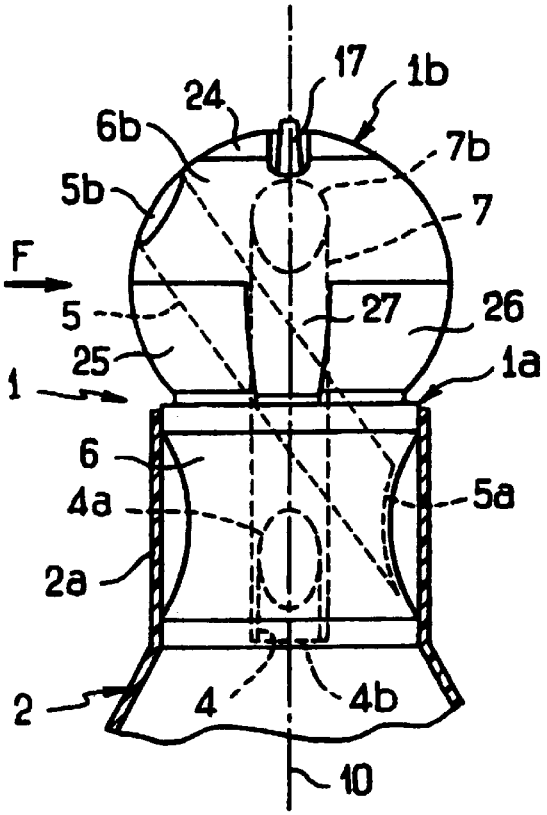
FIG. 1 is a view partially in elevation and partially in cross-section, showing a stopper according to a first embodiment of the invention, wherein the stopper is shown engaged into the neck of the container which is only partially shown.

The stopper 1 shown in FIGS. 1–6 consists of a plastic body, for example in polyurethane having a Shore A hardness between 80 and 120. In the exemplary embodiment shown therein, the body of stopper 1 comprises a cylindrical part 1*a* and a spherical head 1*b* moulded as an integral part. The center of the spherical head 1*b* is located on axis 10 of cylindrical part 1*a*.

Cylindrical part 1*a* of the body is provided for engaging into neck 2*a* of container 2 (FIG. 1) and its diameter is thus sized accordingly. A groove 3 is formed in the peripheral surface of cylindrical part 1*a*. In the exemplary embodiment shown, the groove 3 extends all around the cylindrical part 1*a*, but it may extend only over part of the circumference of the cylindrical part 1*a*.

Figure 2:
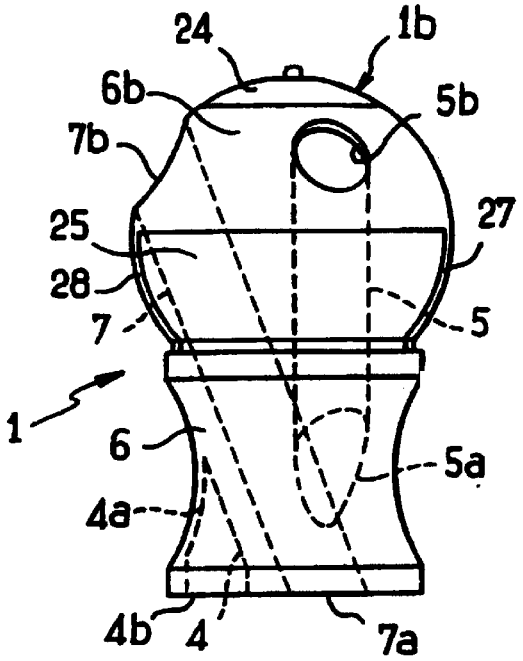
FIG. 2 is a view of one side of the stopper along arrow F in FIG. 1.

A first channel 4 is formed in the cylindrical part 1*a* and emerges at one end in groove 3 through an orifice 4*a* and, at its other end, in the lower end side 1*c* of the stopper body through another orifice 4*b*. A second channel 5 is formed in the stopper's body 1. In the exemplary embodiment shown here, the second channel extends obliquely into the cylindrical part 1*a* and into the spherical head 1*b* and it emerges, at one end, in groove 3 through an orifice 5*a* and, at its other end, in the external surface of spherical head 1*b* through the orifice 5*b*. Orifices 4*a* and 5*a* are spaced apart in the circumferential direction of groove 3, as shown in FIGS. 1 and 2. Instead of extending all around the cylindrical part 1*a*, groove 3 might extend over an arc of circle, the length of which corresponds to the angular distance between both orifices 4*a* and 5*a*. Orifice 5*b* of channel 5 is preferably located in the upper half of spherical head 1*b* and not on axis 10 of the cylindrical part 1*a* of the stopper's body.

A diaphragm 6 in elastomeric material, for example polyurethane having a Shore A hardness between 50 and 60, covers the peripheral surface of the cylindrical part 1*a* of the stopper's body and closely assumes the profile of groove 3 so as to seal orifices 4*a* and 5*a* of channels 4 and 5.

The cylindrical part 1*a* of the stopper's body, covered with diaphragm 6, has a very slightly larger external diameter than the internal diameter of the neck 2*a* of container 2 (FIG. 1), in such a way that stopper 1 may be fixed to container 2 by blocking its cylindrical part 1*a* in neck 2*a*. However, other ways may be considered for fixing the stopper to the neck of the container. For example, the stopper may be provided with a cylindrical skirt surrounding the neck 2*a* and fixed thereto with clips or screws, said cylindrical skirt being connected as an integral part to the stopper's body in the transition area between cylindrical part 1*a* and spherical head 1*b*.

In use, diaphragm 6 acts as a shutoff valve which, at rest, seals orifices 4*a* and 5*a*. Filling of container 2 with a fluid substance may be carried out by pressure injection of said substance into channel 5 through orifice 5*b*. The pressurised substance pushes the elastic diaphragm 6 away into the area of orifice 5*a*, which causes this orifice to open. Next, the substance flows in groove 3 up to orifice 4*a* where it penetrates into channel 4, then flows thereinto in order to penetrate into container 2 through orifice 4*b*. Conversely, under the effect of a pressure increase within container 2, for example by applying pressure on a wall of the latter if it is made out of a flexible material, the substance may, by elastically distorting diaphragm 6, follow a reverse path relatively to the above described path, to exit from stopper through orifice 5*b*. As soon as pressure inside container 2 is released, diaphragm 6 elastically recovers its initial shape and seals once more orifices 4*a* and 5*a*. Accordingly, the shutoff valve formed by diaphragm 6 provides for both filling and emptying of container 2.

It should be noted, however, that for passing from channel 5 to channel 4 or vice versa, the fluid substance must follow a relatively long path and additionally, it must overcome the resistance opposed by diaphragm 6 which tends to elastically recover its initial shape. The substance's flow rate through channels 4 and 5 is thus slowed down by diaphragm 6. This is generally not a problem for emptying the container because, for most of the time, a controlled and relatively slow flow rate is desired instead. On the other hand, possibility of rapidly filling container 2 may be desired, for example in an automatic filling line, without having to increase pressure of the substance which is injected into the container.

For this purpose, the stopper 1 may include a third channel 7, which extends obliquely into the spherical head 1*b* and into the cylindrical part 1*a* of the stopper's body. At one end, channel 7 emerges into the lower end side 1*c* of the cylindrical part 1*a* through an orifice 7*a* and, at its other end, in the upper half of the external surface of spherical head 1*b* through an orifice 7*b*. The elastic diaphragm 6 partially covers the lower end side 1*c* of cylindrical part 1*a* by forming a tab 6*a* (FIGS. 5 and 6) which seals orifice 7*a* of channel 7, but does not seal orifice 4*b* of channel 4. The tab 6*a* of elastic diaphragm 6 thus forms a second shut-off valve which allows flow from channel 7 only from the outside of stopper 1 to the inside of container 2.

Upon filling the container, tab 6*a* opposes a lower resistance against flowing of the fluid substance than in the case the fluid substance is injected into channel 5. Indeed, the span of the surface of tab 6*a* which must be distorted to enable the fluid substance arriving from channel 7 to flow through, is smaller than the span of the surface of diaphragm 6 which must be distorted between orifices 4*a* and 5*a* to enable the fluid substance to flow from channel 5 to channel 4. Additionally, the tab 6*a* may be formed so as to have a lower wall thickness than that of diaphragm 6 in the region of groove 3. Under these conditions, container 2 may be more rapidly filled through channel 7 than through channels 5 and 4.

With the stopper 1 described above, it should be noted that if a depression is created within container 2, air may penetrate thereinto through channels 5 and 4 or through channel 7 if the latter is present. This may be a problem if the substance contained in container 2 must be kept away from air. On the other hand, if there permanently exists in container 2 a pressure above atmospheric pressure, for example if the container contains a fizzy drink or both a fluid substance and a gas propellant, or even if the container has an elastically extendable body providing, after its filling, a spring effect which tends to contract the body of the container and therefore discharge its contents out of the container, the liquid and/or gas contents of the container may then push the diaphragm 6 away and escape through channels 4 and 5. When any air penetration inside container 2 should desirably be avoided or when there exists a permanent pressure in the container, the stopper 1 may be provided with a movable cap which covers the spherical head 1*b* of the stopper and which tightly seals orifice 5*b* of channel 5 and the orifice 7*b* of channel 7 when the latter is present.

Such a cap will now be described with reference to FIGS. 7–12. The cap 8, which is shown in these Figures and which may be produced by injection molding into a plastic material identical to that of the body of stopper 1, includes a spherical cavity 9 (FIGS. 10–12), which is slightly bigger than a hemisphere and has a radius corresponding to the radius of the spherical head 1*b* of stopper 1. Several slots 11 are formed in the edge of cap 8. Together they form elastically distortable tabs 12, so that the spherical head 1*b* of stopper 1 may be fitted into the spherical cavity 9 of cap 8 by elastic snap locking.

After fitting the spherical head 1*b* in cavity 9 of cap 8, a ball joint is formed between these units. On one side, the cap 8 includes a nozzle 13, the internal channel of which 14 emerges into cavity 9 through orifice 14*a*. On the opposite side relatively to the nozzle 13, cap 8 includes an appendix 15 by means of which cap 8 may be rotated relatively to the spherical head 1*b* of stopper 1.

Figure 14:
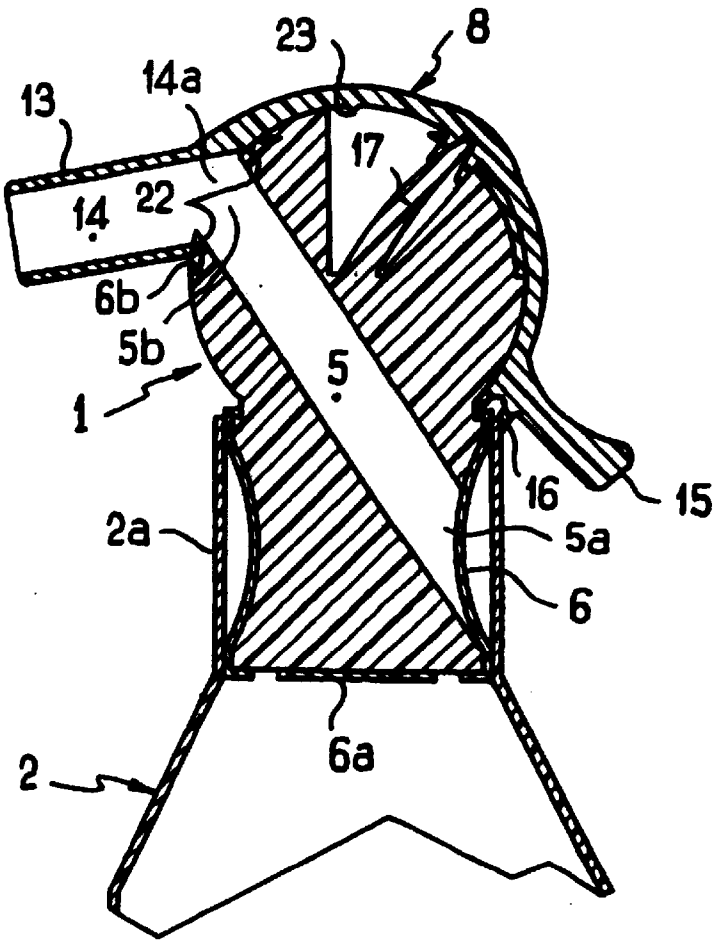
FIGS. 13 and 14 are cross-sectional views showing the stopper from FIGS. 1–6 and cap from FIGS. 7–12 assembled together, wherein the cap is shown in two different positions and the stopper is shown engaged in the neck of a container which is only partially shown.
Figure 13:
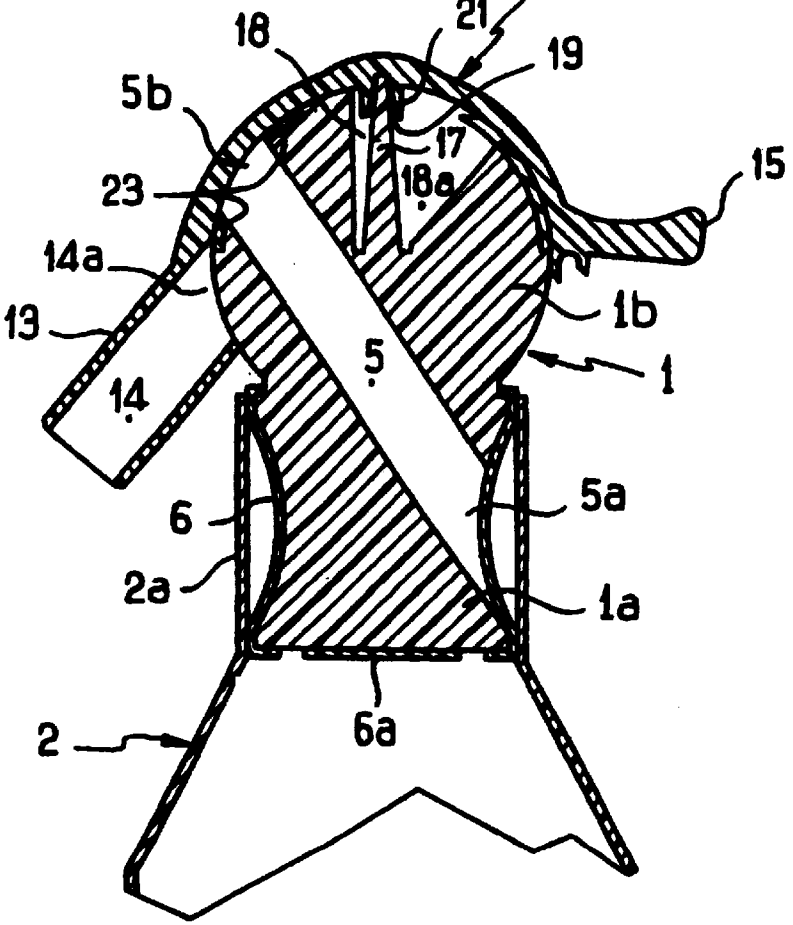

In use, when cap 8 is in place on the spherical head 1*b* of stopper 1 and occupies a first position indicated on FIG. 13, orifice 14*a* of channel 14 does not coincide with orifice 5*b* of channel 5 and accordingly cap 8 seals orifice 5*b*. In this position of cap 8, external air cannot penetrate into the inside of container 2 and contents of container 2 cannot escape outwards. By applying a pressure on the top of appendix 15, for example by means of a finger, cap 8 may be brought from the position shown in FIG. 13 to the position shown in FIG. 14, wherein orifice 14*a* of channel 14 coincides with orifice 5*b* of channel 5, thus making channels 5 and 14 communicate with one another. As particularly apparent in FIGS. 7 and 10–12, a cut 16 is formed in the edge of the cap under appendix 15, in order not to impair rotary motion of cap 8 from the position in FIG. 13 to the position in FIG. 14. As shown in FIG. 14, the bottom of the cut 16 advantageously serves as abutment for defining the limiting position for rotation of cap 8, wherein orifices 5*b* and 14*a* coincide completely with one another. In this position, contents of container 2 may be discharged out of the latter through channels 4 and 5 of stopper 1 and through channel 14 of nozzle 13. In this position of cap 8, it is also possible to fill bottle 2 through channels 14, 5 and 4.

A spring unit is preferably provided for elastically and automatically drawing back the cap 8 into the position shown in FIG. 13 as soon as applied pressure on appendix 15 ceases. As shown in FIGS. 1–6 and FIGS. 13 and 14, the spring unit may advantageously consist of a flexible rod 17, which is integrally formed with the body of stopper 1 and which radially extends into a recess 18 formed in the upper part of spherical head 1*b* of stopper 1. The flexible rod 17 extends from the bottom of recess 18 to a point in the vicinity of the external surface of spherical head 1*b*. The free end of the flexible rod 17 engages into a blind hole 19 formed in the bottom of spherical cavity 9 of cap 8, for example in a cylindrical boss 21 which protrudes radially, on a short distance, into cavity 9 and into recess 18. Preferably, flexible rod 17 and hole 19 have circular cross-sections. When cap 8 is in the position shown in FIG. 13, flexible rod 17 is not distorted and its longitudinal axis coincides with axis 10 of the cylindrical part 1*a* of stopper 1. When pressure is applied on appendix 15, the flexible rod 17 is elastically distorted as shown in FIG. 14 and when appendix 15 is released, it automatically brings cap 11 back into the position shown in FIG. 13.

Figure 3:
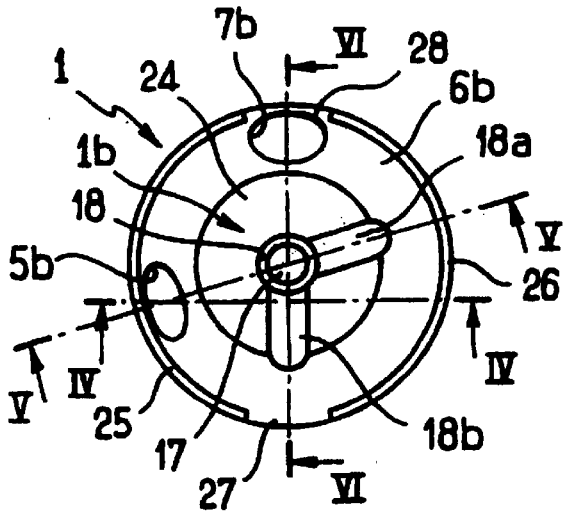
FIG. 3 is a top view of the stopper of FIG. 1.
Figure 4:
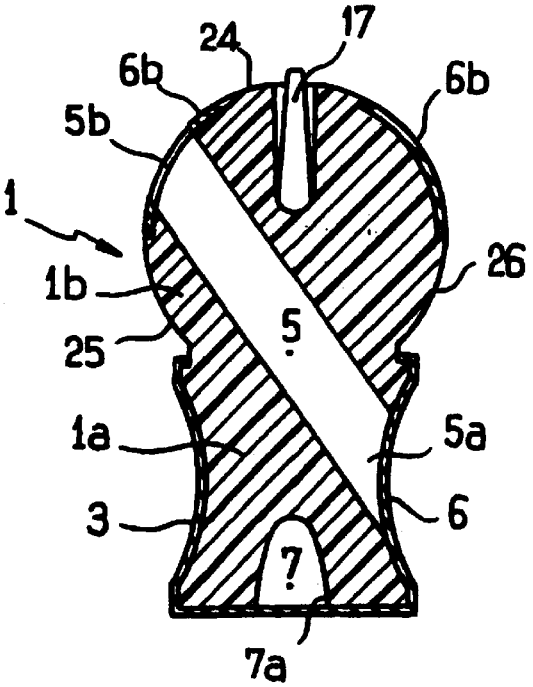
FIGS. 4, 5 and 6 are cross-sectional views, respectively along lines IV—IV, V—V and VI—VI of FIG. 3.
Figure 5:
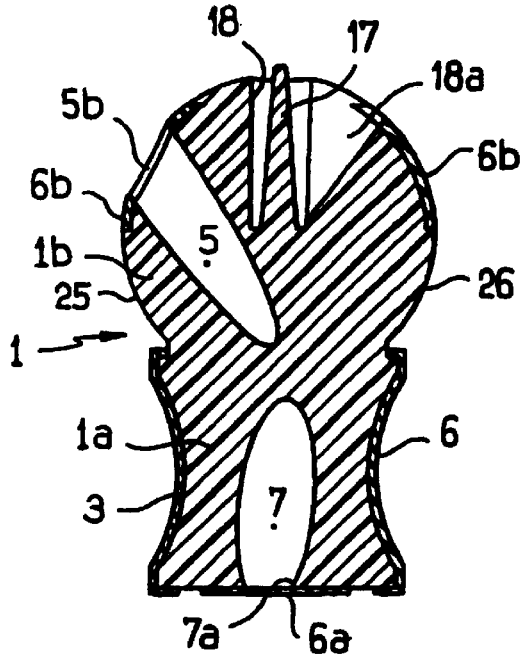
Figure 6:
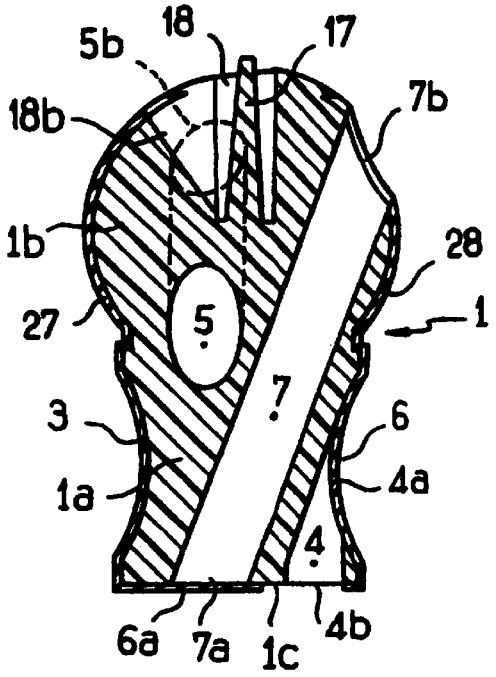
Figure 7:
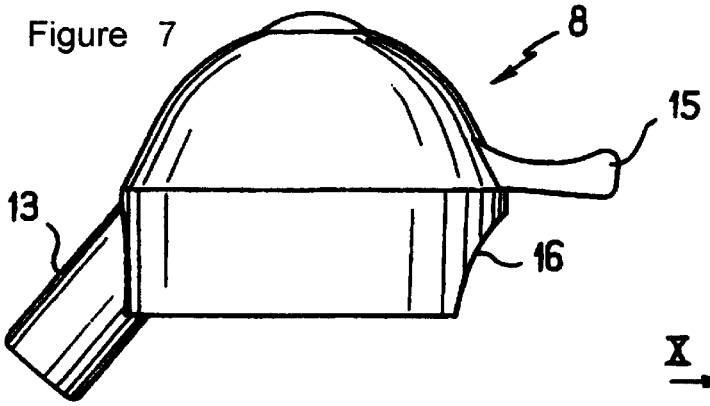
FIGS. 7, 8 and 9 are side, top, front views in elevation, respectively, showing a cap which may be fitted on the spherical head of the stopper in FIGS. 1 to 6.
Figure 8:
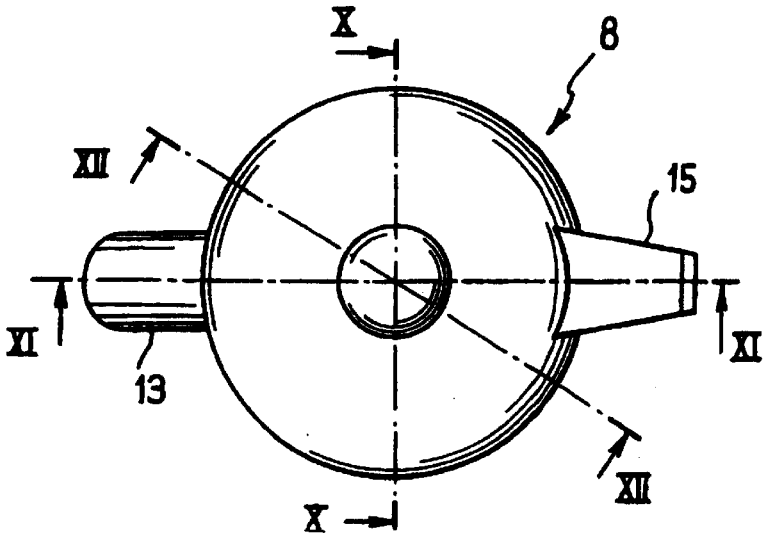
Figure 9:
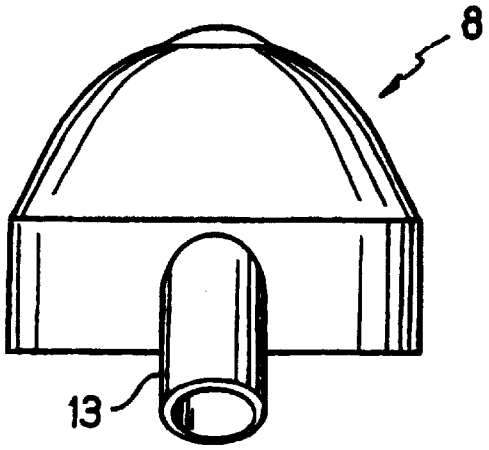
Figure 10:
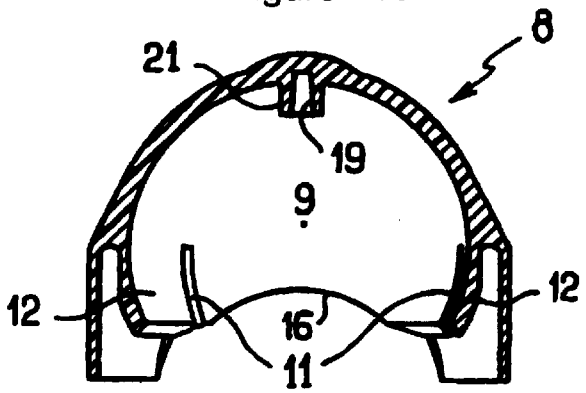
FIGS. 10–12 are cross-sectional views of the cap, along lines X—X, XI—XI and XII—XII of FIG. 8, respectively.

When cap 8 is in either one of the positions shown in FIGS. 13 and 14, nozzle 13 and appendix 15 are located in the plane indicated by line V—V in FIG. 3. If channel 7 is provided, for filling the container, cap 8 must first be rotated around axis 10 of the cylindrical part 1*a* of the body of the stopper, which is also the longitudinal axis of flexible rod 17, from a position shown in FIG. 13 to a position in which nozzle 13 and appendix 15 are in a plane corresponding to the line VI—VI indicated in FIG. 3, i.e. a rotation of about 106° in the example described herein. Next, by pressing on appendix 15, the cap is brought by rotation on the spherical head 1*b* into a position similar to the one shown in FIG. 14, but in this case, orifice 14*a* of channel 14 coincides with orifice 7*b* of channel 7, thus allowing for filling of the container through channel 7. Once again, as soon as appendix 15 is released, flexible rod 17 brings the cap 8 back into a position similar to the one shown in FIG. 13 in order to seal orifice 7*b* of channel 7.

Both angular positions of cap 8, which correspond to lines V—V and VI—VI of FIG. 3 respectively and wherein channel 14 of nozzle 13 may be brought into coincidence either with channel 5 or with channel 7 of stopper 1, may be defined by abutments (not shown) provided on stopper 1 and/or on cap 8. For example, a prominence may be provided on the stopper 1 in such a position that it just snaps elastically into one of the slots 11 of cap 8 when the latter is in a angular position corresponding to line V—V of FIG. 3, and into another slot 11 of cap 8 when the latter is in an angular position corresponding to line VI—VI of FIG. 3. Similarly, another slot 11 may be provided in an angular position so as to enable cap 8 to be maintained in an intermediate position between the two angular positions corresponding to lines V—V and VI—VI of FIG. 3, intermediate position in which channel 14 of nozzle 13 can neither be brought into coincidence with channel 5, nor with channel 7.

In order to be able to bring cap 8 into a position corresponding to the one shown in FIG. 14, only when it is in either one of two angular positions corresponding respectively to lines V—V and VI—VI of FIG. 3, the recess 18 formed in the upper part of spherical head 1*b* does not assume a regular shape but preferably includes, as seen from above (FIG. 3), a central part, which is cylindrical and in which the flexible rod 17 extends axially when it is not distorted, and two notches 18*a* and 18*b* which radially emerge into the central cylindrical part of recess 18 in positions corresponding to lines V—V and VI—VI of FIG. 3 respectively. Notches 18*a* and 18*b* have a width which is just slightly greater than the diameter of the cylindrical boss 21 of cap 8, so that boss 21 and flexible rod 17 may engage in either one of notches 18*a* and 18*b* only when cap 8 is in an angular position corresponding to either one of both notches.

To ensure perfect sealing of orifice 5*b* of channel 5 when cap 8 is in the position shown in FIG. 13 and to avoid leaks between cap 8 and spherical head 1*b* of stopper 1, a sealing gasket may be positioned around orifice 5*b* and, if channel 7 is present, also around orifice 7*b* of this channel.

Figure 11:
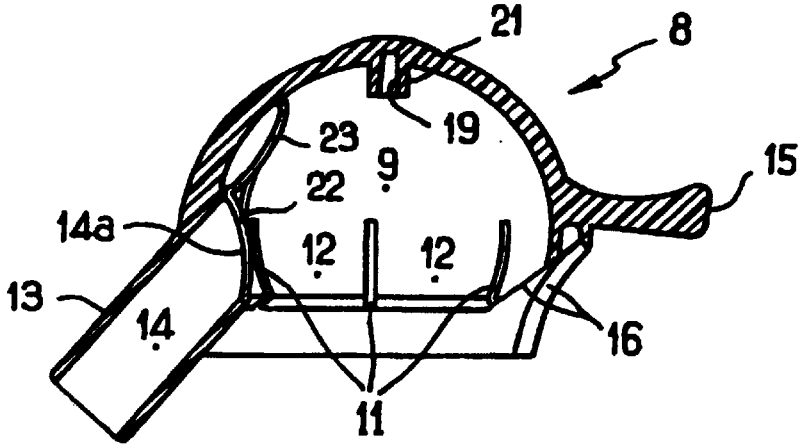
Figure 12:
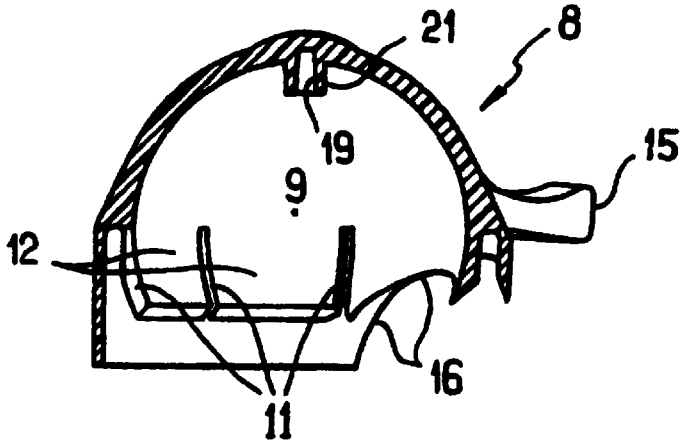

According to a particularly advantageous embodiment, the diaphragm 6 which is of elastomeric material may also cover selected regions of the spherical head 1*b* of stopper 1, particularly around orifices 5*b* and, if need be, 7*b*, in order to form the aforementioned sealing gasket(s). As shown in FIGS. 1–6, diaphragm 6 covers at 6*b*, a spherical zone of the spherical head 1*b*, except for orifices 5*b* and 7*b* located in this spherical zone. Additionally, as shown in FIG. 11, two circular protruding beads 22 and 23 are formed on the surface of cavity 9 of cap 8. Bead 22 surrounds orifice 14*a* of channel 14 and rests on the portion 6*b* of the diaphragm in elastomeric material, around orifice 5*b* of channel 5, when cap 8 is in the position shown in FIG. 14. Bead 23, located just above bead 22, is positioned so as to rest on the portion 6*b* of the diaphragm in elastomeric material, around orifice 5*b*, when cap 8 is in the position shown on FIG. 13.

If channel 7 is provided, two other pairs of beads (not shown) similar to beads 22 and 23 may be provided for co-operating with the portion 6*b* of diaphragm which surrounds orifice 7*b* of channel 7 when cap 8 is either one of the positions shown in FIGS. 13 and 14 and corresponding to the angular position indicated by line V—V of FIG. 3, and for co-operating with portion 6*b* of the diaphragm surrounding orifice 5*b* when cap 8 is in an angular position indicated by line VI—VI in FIG. 3.

Preferably, portion 6*b* shaped as a spherical zone of the diaphragm in elastomeric material does not cover the whole spherical head 1*b* of stopper 1, but portions 24, 25 and 26 of said spherical head remain exposed in order to ensure good guiding of cap 8 in its rotational movement around the spherical head. Portion 6*b* shaped as a spherical zone of the diaphragm is connected as an integral part, by bridges of elastomeric material 27 and 28, to the portion of the diaphragm 6 which surrounds the cylindrical part 1*a* of stopper 1. All the portions of the diaphragm 6 may thus be formed as an integral part by injecting elastomeric material into the mould through a unique injection orifice.

Although the stopper described above may be used for stopping all sorts of containers provided with a neck, it is particularly suitable for containers for which internal capacity or volume may vary between an almost zero value and a nominal value.

Figure 15:
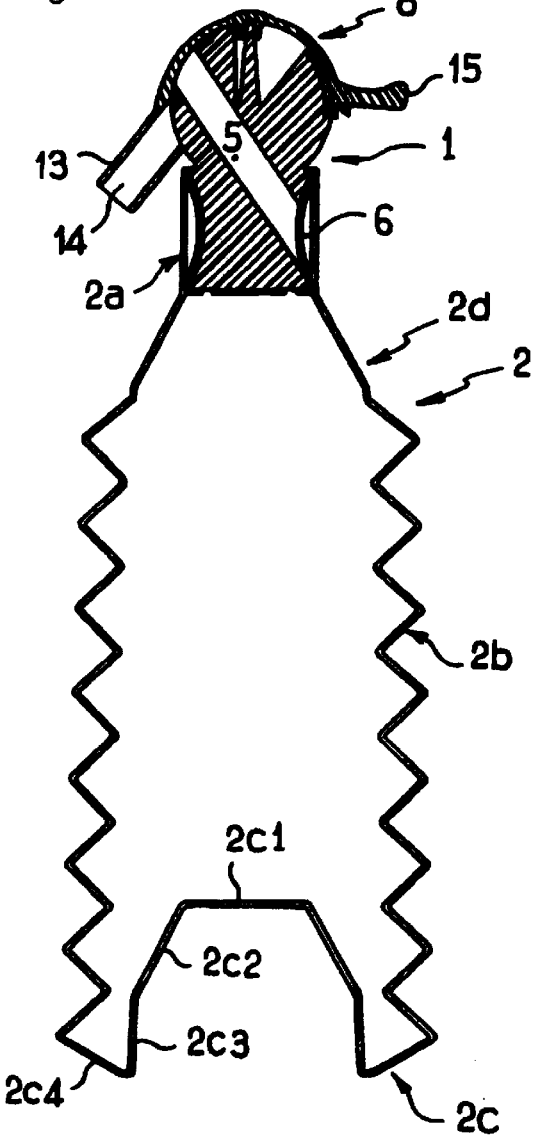
FIGS. 15 and 16 are cross-sectional views showing the stopper according to the invention on a variable capacity bottle, wherein the bottle is shown in two different conditions.
Figure 16:
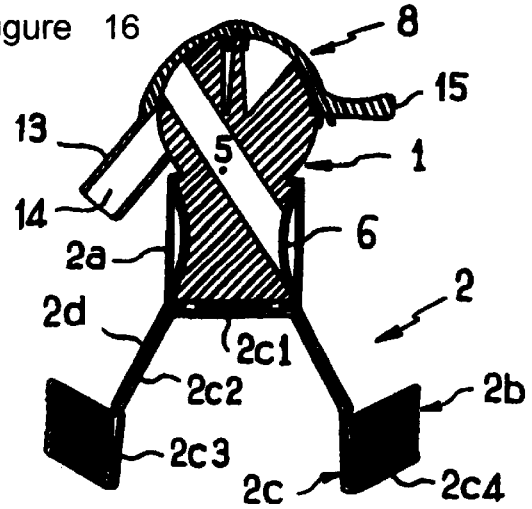

FIGS. 15 and 16 show an example of such a variable capacity container 2, stopped by a stopper 1, with cap 8, accordingly to those which have been described earlier with reference to FIGS. 1–14. The container 2 shown in FIGS. 15 and 16, for example a bottle, comprises, in addition to the neck 2*a*, a body 2*b* and a hollow bottom 2*c*.

The body 2*b* has a compressible bellows-shaped wall extendable in a longitudinal direction of bottle 2. If body 2*b* has a larger diameter than that of neck 2*a*, it connects to the latter by a nozzle 2*d*, for example, having a truncated shape. The body 2*b*, however, may have been directly connected to neck 2*a* if the body diameter, at the internal folds of the bellows, is equal to that of neck 2*a*.

The bottom 2*c*, which is relatively stiff with respect to the bellows-shaped body 2*b*, includes a central part 2*c*1, followed by a wide-mouthed part 2*c*2, for example having a truncated shape, itself followed by a substantially cylindrical part 2*c*3 and by an external ring-shaped part 2*c*4 which connects through a folding line to the lower part of the bellows-shaped body 2*b*. Part 2*c*2 of bottom 2*c*has shape and dimensions which exactly match those of neck 2*d* of bottle 2. If body 2*b* directly connects to neck 2*a*, part 2*c*2 of bottom 2*c* is absent and parts 2*c*1 and 2*c*3 of bottom directly connect to one another. Part 2*c*3 of bottom 2*c* has an axial length and a diameter which correspond to the axial length and to the internal diameter of the bellows of body 2*b* respectively when the latter is completely compressed, as is apparent in FIG. 16.

So, when body 2*b* of the bottle 2 is fully compressed, part 2*c*2 of bottom 2*c* closely and fully matches the internal surface of neck 2*d* of the bottle and the central part 2*c*1 of bottom 2*c* is practically in contact with the lower end surface of stopper 1. In this condition, the internal volume of bottle 2 is almost zero (FIG. 16). Such a variable capacity bottle is described in more details in the French Patent Application filed on the same day as the present patent application, on behalf of the same applicant, and which is entitled: "Variable capacity plastic bottle".

When bottle 2 is in the condition shown in the FIG. 16, it may be filled with a fluid substance without the latter being in contact with air from the environment. For this, rotating cap 8 is sufficient for bringing channel 14 of its nozzle 13 in coincidence with channel 5 of stopper 1 (or in coincidence with channel 7 if the latter is provided) followed by injecting the filling substance into channel 14 by means of an injector fitted to nozzle 13. As soon filling of the bottle is completed, cap 8 is brought back into the position shown in the FIGS. 13 or 15 in order to keep the contents of bottle 2 away from air. Every time the bottle is used, cap 8 is momentarily put into the position shown in FIG. 14 and the desired quantity of fluid substance contained in bottle 2 is discharged out of the latter through channels 4 and 5 of stopper 1 and through channel 14 of nozzle 13 by applying pressure on the bottom 2*c* of bottle 2 and/or by taking advantage of the spring effect of the plastic material forming the bellows-shaped body 2*b*. When the desired quantity of fluid substance has been obtained, appendix 15 of cap 8 is released and the cap automatically comes back into the position of FIGS. 13 or 15 in order to seal channel 5 and thus keep the contents of bottle 2 away from air.

Figure 17:
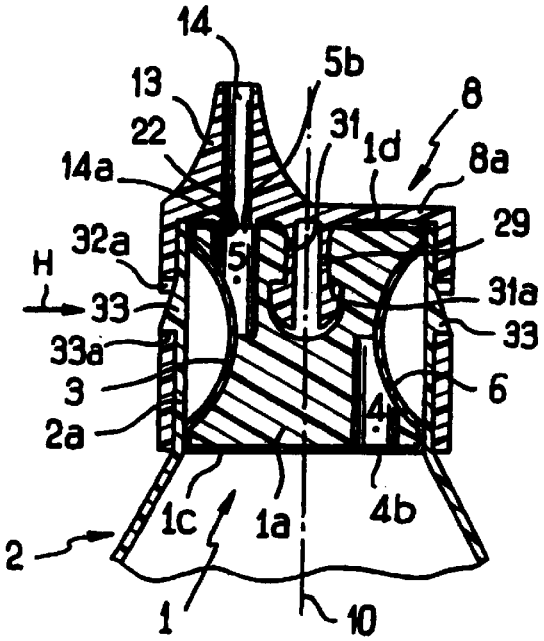
FIG. 17 is a cross-sectional view showing a stopper with a cap, according to a second embodiment of the invention, on the neck of a container which is only partially shown.
Figure 18:
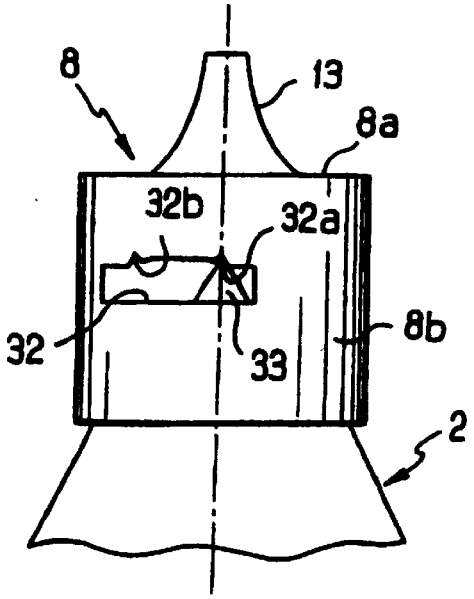
FIG. 18 is a view in elevation along arrow H in FIG. 17.

FIGS. 17 and 18 show another embodiment of the stopper according to the invention. In theses figures, units which are the same or which play the same role as those of the embodiment described above are referred to by the same reference numbers and they shall not be once again described in detail. The body of stopper 1 shown in FIG. 17 does not include any spherical head, but has only a cylindrical part 1*a* with a groove 3 in its peripheral surface. Diaphragm 6 in elastomeric material totally covers the peripheral surface of the cylindrical part 1*a* and preferably, also its two end sides 1*c* and 1*d*, except for orifices 4*b* and 5*b* of channels 4 and 5. Preferably, these channels 4 and 5 extend into the cylindrical part 1*a* of the body of the stopper, from its end sides, parallel to its longitudinal axis 10. Orifice 5*b* of channel 5 is eccentric relatively to axis 10. Cap 8 is rotatively mounted on the body of the stopper around axis 10, without there being any possibility of any axial movement relatively to the body of the stopper. For this purpose, the upper wall 8*a* of cap 8 includes, at its center, a cylindrical pin 29, which axially protrudes into the cavity of cap 8 and which engages into a cylindrical blind hole 31, of a diameter matching that of pin 29, formed in the body 1*a* of stopper 1 at the center of its upper end side 1*d*. Hole 31 is widened in the region of its bottom, in order to form a ring-shaped shoulder 31*a*. The free end of pin 29 is widened correspondingly and pin 29 is longitudinally split so as to form two legs which are spaced apart and which may be elastically distorted in order to enable the pin 29 to engage into hole 31. Lengths of the parts with the smallest diameter of the pin 29 and hole 31 are selected in such a way that after engagement of pin 29 into hole 31, the upper wall 8*a* of cap 8 is in sliding contact with the upper end side 1*d* of body 1*a* of the stopper and cap 8 may rotate around axis 10, without there being any possibility of an axial movement along axis 10, because of shoulder 31*a*.

As in the previous embodiment, cap 8 includes a nozzle 13 which protrudes here on wall 8*a* of cap 8. Channel 14 of nozzle 13 extends parallel to axis 10 and emerges in the region of the upper end side 1*d* of body 1*a* through an orifice 14*a* which is eccentric relatively to axis 10 with the same eccentricity as orifice 5*b* of channel 5. By rotating cap 8 around axis 10, orifice 14*a* of channel 14 may thus be brought in coincidence with orifice 5*b* of channel 5, in only one rotation position of cap 8, as shown in FIG. 17. In all the other rotation positions of cap 8, the latter seals orifice 5*b*.

Preferably, cap 8 includes a cylindrical skirt 8*b*, which surrounds neck 2*a* of container 2 and which includes, in its wall, at least two oblong apertures 32. Both apertures 32 extend in the direction of the circumference of skirt 8*b* and, in use, they co-operate with protruding lugs 33 on the external surface of neck 2*a* of container 2. As shown on FIG. 17, lugs 33 have, as seen in a longitudinal sectional view, a triangular profile which defines a shoulder 33*a* which co-operates with the lower edge of the corresponding aperture 32 of skirt 8*b* for axially blocking cap 8 after that its skirt 8*b* has engaged around neck 2*a* of container 2. Lugs 33 are also useful for limiting the magnitude of the rotary movement of cap 8 around axis 10. Although this may be obtained by having lugs 33 come and abut against the ends of apertures 32, two notches 32*a* and 32*b* are preferably provided as shown in FIG. 18 in the upper edge of at least one of the apertures 32. In this case, at least one of the two lugs 33 may also have, as seen in the direction of arrow H of FIG. 17, a triangular shape so as to be able to snap into either one of both notches 32*a* and 32*b* and thus lock cap 8 in the corresponding angular position. Notch 32*a* is formed in such a position that when lug 33 is snapped into this notch, channel 14 of nozzle 13 coincides with channel 5 of body 1*a* of the stopper, whereas notch 32*b* is formed in such a position that when lug 33 is snapped in this notch, lid 8 seals channel 5.

As shown in FIGS. 17 and 18, nozzle 13 may have at least a partially conical shape. So, when container 2, the shape of which may be similar to that shown in FIGS. 15 and 16, comprises the reservoir of a syringe, nozzle 13 may also be used as a tip for receiving a syringe's needle.

It should be apparent that the embodiments of the invention described above have been given as purely indicative and non limiting examples, and that many alterations may be performed by one skilled in the art without departing to any extent from the scope of the invention. This is notably so if the sealing gasket which is located around orifice 5*b* of channel 5, as well as, if need be, the one which is located around orifice 7*b* of channel 7, instead of being formed by a portion of the diaphragm 6, for example, consists of an O-ring housed in a circular groove formed around the matching orifice of channel 5 or of channel 7. In the embodiment of FIG. 17, a third channel having the same function as channel 7 in the embodiment of FIGS. 1–6 may also be formed in the cylindrical part 1*a* of the body of the stopper 1. In the embodiment of FIG. 17, if pressure inside the container 2 always remains low, it is possible to omit lugs 33 and the skirt 8*b* of cap 8 may be suppressed or extremely shortened. In addition, if channel 7 and cap 8 are lacking from stopper 1, the orifice 5*b* of channel 5 may be located at the top of spherical head 1*d* or in the middle of the upper end side 1*d* of the body of stopper 1 and a nozzle similar to nozzle 13 may be formed as an integral part with the body of the stopper, whereby a small removable cap may be provided for blocking said nozzle.

What is claimed is:

1. A stopper for a container having a neck, comprising a body (1) fixed and sealed to the neck (2*a*) of said container (2) and wherein at least a duct is formed for emptying the container, and a shutoff valve for closing said duct, the body (1) of the stopper including a cylindrical part (1*a*) for engaging into the neck (2*a*) of the container (2), the duct comprising a first channel (4) and a second channel (5) which are separated from each other, and extend into the cylindrical part (1*a*) of the body and emerge, at one of their ends, in the peripheral surface of the cylindrical part (1*a*) of the body (1) through first and second orifices (4*a* and 5*a*), respectively, spaced from one another in the circumferential direction of the cylindrical part (1*a*) of the body (1), the first channel (4) emerging, at its other end, through a third orifice (4*b*) located in a first end surface (1*c*) of body (1) which, in use, is located inside said container (2), the second channel (5) emerging, at its other end, through a fourth orifice (5*b*) located in a second end surface of the body (1) which, in use, is located outside the container (2), wherein the shut-off valve is formed by a diaphragm (6) of elastomeric material, which tightly encircles the cylindrical part (1*a*) of body (1) by covering the first and second orifices (4*a* and 5*a*) of both said first and second channels (4 and 5) and which, through its elastic distortion, allows a fluid substance to flow both from inside to outside of the container and from outside to inside of said container, the cylindrical part (1*a*) of the body (1) of the stopper, covered with the diaphragm (6), has a selected external diameter for ensuring, in use, a close fitting of body (1) into the neck (2*a*) of container (2) and has in its cylindrical surface a groove (3) which extends circumferentially on at least a portion of the circumference of said cylindrical part (1*a*), and that the diaphragm (6) closely matches the shape of the surface of the groove (3) and said first and second orifices (4*a* and 5*a*) of both channels (4 and 5) are located in the groove (3).

2. Stopper according to claim 1, wherein said groove (3) extends all around the cylindrical part (1*a*) of said body (1).

3. Stopper according to claim 1 or 2, wherein said body (1) of the stopper includes additionally a cylindrical head (1*b*) which is integrally formed with the cylindrical part (1*a*) of the body and which, in use, is located on the outside of neck (2*a*) of said container (2), the head (1*b*) having its center on an axis (10) of said cylindrical part (1*a*) and the second channel (5) also extends obliquely in said head (1*b*), the external surface of which forms said second end surface of the body (1).

4. Stopper according to claim 3, wherein said fourth orifice (5*b*) is located in the upper half of head (1*b*) and is not located on the axis (10) of cylindrical part (1*a*).

5. Stopper according to claim 3, wherein said head (1*b*) is covered with a cap (8) having a spherical cavity (9), the radius of which matches the radius of the head (1*b*), with elastic snapping, into the spherical cavity of the cap so as to form a ball joint allowing for rotation of the cap relative to the head (1*b*), and said cap (8) includes, on one side, a nozzle (13), an internal channel (14) which emerges into the spherical cavity (9) of the cap through a fifth orifice (14*a*) which, in a first rotation position of the cap, coincides with a fourth orifice (5*b*) of the second channel (5) of the body (1) and, in a second rotation position of the cap does not coincide with said fourth orifice (5*b*), so that the latter is blocked by said cap (8).

6. Stopper according to claim 5, including a spring unit for elastically bringing the cap (8) back to its second rotation position.

7. Stopper according to claim 6, wherein a recess (18) is formed in the upper part of the head (1*b*), and that said spring unit is formed by a flexible rod (17) which is integrally formed with the body of the stopper (1) and radially extends into said recess (18) from the bottom of the latter up to a point near the external surface of the head (1*b*), and said cap (8) includes, in the bottom of its spherical cavity (9), a blind hole (19) in which the free end of said flexible rod (17) engages.

8. Stopper according to claim 3 wherein a third channel (7) is formed in the body of the stopper (1) and emerges through a sixth orifice (7*a*) in the first end surface (1*c*) of the body of the stopper (1) and by a seventh orifice (7*b*) in the spherical surface of the cylindrical head (1*b*), the diaphragm (6) partially covers the first end surface (1*c*) of the body, including the seventh orifice (7*a*), but excluding the first orifice (4*a*), so as to form another shut-off valve allowing only flow in the third channel (7) from outside to inside of the container (2).

9. Stopper according to claim 7, wherein said flexible rod (17) and blind hole (19) have a circular cross section and the cap (8) is rotated around the longitudinal axis of the flexible rod (17) from the second rotation position up to a third rotation position and is rotated, with flexing of the flexible rod (17) from the third rotation position up to a fourth rotation position in which the fifth orifice (14*a*) of nozzle (14) coincides with the seventh orifice (7*b*) of the third channel (7), wherein said seventh orifice is blocked by said cap (8) in all the other rotation positions thereof and the cap is elastically brought from its fourth position back to its third position by the flexible rod (17).

10. Stopper according to claim 8, wherein a sealing gasket (6*b*) is positioned around the fourth orifice (5*b*) and, optionally, around the seventh orifice (7*b*).

11. Stopper according to claim 10, wherein said diaphragm (6) also covers at least some selected areas of the head (1*b*) around the fourth orifice (5*b*) and, optionally, around the seventh orifice (7*b*) so as to form said sealing gasket(s) (6*b*).

12. Stopper according to claim 5, wherein cap (8) includes, on an opposite side with regards to the nozzle (13), an appendix (15) by means of which the cap (8) may be rotated.

13. Stopper according to claim 1 or 2, wherein a fourth orifice (5*b*) of the second channel (5) occupies an eccentric position relatively to the axis (10) of the cylindrical part (1*a*) of the body (1), in that the second end surface (1*d*) of the cylindrical part (1*a*) of the body (1) is covered by a cap (8) which is rotatively mounted on the body around the axis (10) of its cylindrical part (1*a*) without there being any possibility of an axial movement relatively to the body, said cap (8) being in sliding contact with the second end surface (1*d*) and including a nozzle (13), the internal channel (14) of which emerges in the area of the second end surface (1*d*) of the body through a fifth orifice (14*a*) which is eccentric relatively to axis (10) of the cylindrical part (1*a*) so as to be in coincidence with the fourth orifice (5*b*) of the second channel (5) for only one rotation position of cap (8), the latter acting as a seal in all its other rotation positions.

14. Stopper according to claim 13, including a sealing gasket positioned around the fourth orifice (5*b*).

15. Stopper according to claim 14, wherein diaphragm (6) also covers the second end surface (1*d*) of the body so as to form said sealing gasket.

16. Stopper according claim 13, wherein cap (8) includes a cylindrical skirt (8*b*) which surrounds the neck (2*a*) of the container (2) and which includes in its wall at least two oblong apertures (32) which extend in the circumferential direction of the cylindrical skirt (8*b*) and which, in use, co-operate with lugs (33) protruding on the external surface of the neck (2*a*) both for limiting the angular displacement of cap (8) relatively to neck (2*a*) and to the body of stopper (1) and for axially blocking the cap relatively to the neck.

17. Container according claim 1, including a body (2*b*) and a hollow bottom (2*c*), wherein the body has a compressible bellows-shaped wall extendable in the longitudinal direction of the container (2), the hollow bottom (2*c*) including a central part (2*c*1), a substantially cylindrical part (2*c*3) and an external ring-shaped part (2*c*4) which is connected by a folding line to the lower part of the bellows-shaped body (2*b*) of said container (2), wherein the substantially cylindrical part (2*c*3) of bottom (2*c*) has an axial length and a diameter which correspond to the axial length and the internal diameter of the bellows respectively when the latter is completely compressed, and the central part (2*c*1) of bottom (2*c*) is in contact with the first end surface (1*c*) of the body of the stopper (1) in the completely compressed condition of the bellows forming the body (2*b*) of container (2) which, in this condition of the bellows, has an internal volume practically equal to zero.

* * * * *